US007347746B1

(12) United States Patent
He

(10) Patent No.: US 7,347,746 B1
(45) Date of Patent: Mar. 25, 2008

(54) RECEPTACLE CONNECTOR ASSEMBLY

(75) Inventor: Tom X. He, Simi Valley, CA (US)

(73) Assignee: Boston Scientific Neuromodulation Corporation, Valencia, CA (US)

( * ) Notice: Subject to any disclaimer, the term of this patent is extended or adjusted under 35 U.S.C. 154(b) by 0 days.

(21) Appl. No.: 11/588,759

(22) Filed: Oct. 27, 2006

(51) Int. Cl.
*H01R 13/187* (2006.01)

(52) U.S. Cl. ..... 439/843; 439/851

(58) Field of Classification Search ..... 439/842, 439/843, 846, 851, 651, 638, 954, 251, 847
See application file for complete search history.

(56) References Cited

U.S. PATENT DOCUMENTS 3,107,966 A * 10/1963 Bonhomme ..... 439/843
3,760,984 A 9/1973 Theeuwes
3,845,770 A 11/1974 Theeuwes et al.
3,916,899 A 11/1975 Theeuwes et al.
3,923,426 A 12/1975 Theeuwes
3,987,790 A 10/1976 Eckenhoff et al.
3,995,631 A 12/1976 Higuchi et al.
4,016,880 A 4/1977 Theeuwes et al.
4,036,228 A 7/1977 Theeuwes
4,111,202 A 9/1978 Theeuwes
4,111,203 A 9/1978 Theeuwes
4,203,440 A 5/1980 Theeuwes
4,203,442 A 5/1980 Michaels
4,210,139 A 7/1980 Higuchi
4,327,725 A 5/1982 Cortese et al.
4,360,019 A 11/1982 Portner et al.
4,487,603 A 12/1984 Harris
4,562,751 A 1/1986 Nason et al.
4,627,850 A 12/1986 Deters et al.
4,678,408 A 7/1987 Nason et al.
4,685,903 A 8/1987 Cable et al.
4,692,147 A 9/1987 Duggan
4,725,852 A 2/1988 Gamblin et al.
4,865,845 A 9/1989 Eckenhoff et al.
4,886,471 A * 12/1989 Fleshman, Jr. ..... 439/587
4,941,472 A 7/1990 Moden et al.
5,057,318 A 10/1991 Magruder et al.
5,059,423 A 10/1991 Magruder et al.
5,080,653 A 1/1992 Voss et al.
5,097,122 A 3/1992 Colman et al.

(Continued)

FOREIGN PATENT DOCUMENTS

WO WO 01/82398 A1 1/2001

(Continued)

*Primary Examiner*—Tho D. Ta
*Assistant Examiner*—Travis Chambers
(74) *Attorney, Agent, or Firm*—Fish & Richardson P.C.

(57) ABSTRACT

A receptacle connector assembly configured to mate with a pin array connector assembly having a number of pins includes a number of socket assemblies. Each socket assembly includes a sleeve surrounding a number of conductive wires that form a cavity for receiving and making electrical contact with a corresponding pin within the pin array connector assembly. A method of making a receptacle connector assembly configured to mate with a pin array connector assembly having a number of pins includes forming a number of socket assemblies and molding the socket assemblies into an insulative housing. Each socket assembly includes a sleeve surrounding a number of conductive wires that form a cavity for receiving and making electrical contact with a corresponding pin within the pin array connector assembly.

13 Claims, 17 Drawing Sheets

U.S. PATENT DOCUMENTS 5,112,614 A 5/1992 Magruder et al.
5,137,727 A 8/1992 Eckenhoff
5,193,539 A 3/1993 Schulman et al.
5,193,540 A 3/1993 Schulman et al.
5,203,813 A * 4/1993 Fitzsimmons et al. ..... 29/876
5,234,692 A 8/1993 Magruder et al.
5,234,693 A 8/1993 Magruder et al.
5,273,443 A * 12/1993 Frantz et al. ..... 439/595
5,312,439 A 5/1994 Loeb
5,427,541 A 6/1995 Calio
5,501,703 A 3/1996 Holsheimer et al.
5,728,396 A 3/1998 Peery et al.
5,938,688 A 8/1999 Schiff
5,951,595 A 9/1999 Moberg et al.
6,016,449 A 1/2000 Fischell et al.
6,051,017 A 4/2000 Loeb et al.
6,070,103 A 5/2000 Ogden
6,164,284 A 12/2000 Schulman et al.
6,185,452 B1 2/2001 Schulman et al.
6,208,894 B1 3/2001 Schulman et al.
6,219,580 B1 4/2001 Faltys et al.
6,272,382 B1 8/2001 Faltys et al.
6,280,873 B1 8/2001 Tsukamoto
6,308,101 B1 10/2001 Faltys et al.
6,368,315 B1 4/2002 Gillis et al.
6,381,496 B1 4/2002 Meadows et al.
6,428,368 B1 8/2002 Hawkins
6,458,171 B1 10/2002 Tsukamoto
6,487,446 B1 11/2002 Hill et al.
6,516,227 B1 2/2003 Meadows et al.
6,539,263 B1 3/2003 Schiff et al.
6,553,263 B1 4/2003 Meadows et al.
6,620,151 B2 9/2003 Blischak et al.
6,666,845 B2 12/2003 Hooper et al.
6,740,072 B2 5/2004 Starkweather et al.
6,760,626 B1 7/2004 Boveja
6,770,067 B2 8/2004 Lorenzen et al.
6,796,803 B2 9/2004 Abe
2001/0046625 A1 11/2001 Ruth, II et al.
2001/0053476 A1 12/2001 Ruth et al.

FOREIGN PATENT DOCUMENTS

WO WO 03/005465 A1 1/2003

* cited by examiner

RECEPTACLE CONNECTOR ASSEMBLY

BACKGROUND

A wide variety of medical conditions and disorders have been successfully treated using implantable medical devices. Such implantable devices include, but are not limited to, stimulators, pacemakers, and defibrillators.

It is often desirable to electrically couple an implantable medical device to another device. For example, an implantable device may be coupled to a lead having a number of electrodes disposed thereon so that the device may deliver electrical stimulation to a site within the body. Additionally or alternatively, an implantable device may be electrically coupled to an external device configured to communicate with and support the implantable device.

To facilitate electrical coupling to another device, many implantable devices include one or more connector assemblies. A common type of connector assembly includes an array of pins configured to detachably mate with a receptacle connector assembly having a corresponding pattern of female sockets or holes.

With advancements in technology, many implantable devices have become increasingly complex and smaller in size. Hence, the need for small, reliable pin array connectors and corresponding receptacle connectors has increased.

However, it is currently difficult and costly to manufacture small connectors for implantable medical devices because stringent dimensional and geometrical tolerance requirements must be met. Moreover, most receptacle connectors have sockets that are made out of a rigid metal. This rigidity may result in undesirable stress when connected to a corresponding pin array connector that may cause device malfunction.

SUMMARY

A receptacle connector assembly configured to mate with a pin array connector assembly having a number of pins includes a number of socket assemblies. Each socket assembly includes a sleeve surrounding a number of conductive wires that form a cavity for receiving and making electrical contact with a corresponding pin within the pin array connector assembly.

A method of making a receptacle connector assembly configured to mate with a pin array connector assembly having a number of pins includes forming a number of socket assemblies and molding the socket assemblies into an insulative housing. Each socket assembly includes a sleeve surrounding a number of conductive wires that form a cavity for receiving and making electrical contact with a corresponding pin within the pin array connector assembly.

BRIEF DESCRIPTION OF THE DRAWINGS

The accompanying drawings illustrate various embodiments of the principles described herein and are a part of the specification. The illustrated embodiments are merely examples and do not limit the scope of the disclosure.

Throughout the drawings, identical reference numbers designate similar, but not necessarily identical, elements.

DETAILED DESCRIPTION

A receptacle connector assembly and methods of making the same are described herein. The receptacle connector assembly is configured to mate with a pin array connector assembly having a number of pins and includes a number of socket assemblies. Each socket assembly includes a sleeve surrounding a number of conductive wires that form a cavity for receiving and making electrical contact with a corresponding pin within the pin array connector assembly. The socket assemblies are housed within an insulative housing made of any suitable elastomer.

As will be described in more detail below, the receptacle connector assembly described herein is compliant with pin array connector assemblies having various pin misalignments and/or variation in dimension and flexible so as to minimize damage caused by the mating process and/or normal usage of the connectors. Moreover, use of the receptacle connector assembly described herein may minimize undesirable stress placed on the pins when mated with the socket assemblies.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

As used herein and in the appended claims, the terms "implantable medical device," "implanted device" and variations thereof will be used broadly to refer to any type of device that is implanted within a patient to perform any function. For example, the implantable device may be, but is not limited to, a stimulator, pacemaker, or defibrillator.

It will be recognized that the connector assemblies described herein may be used with any device configured to be electrically coupled to another device and are not limited to use with implantable devices only. For example, the connector assemblies described herein may be used with computers, computer accessories, electromechanical devices, or any other device. However, for illustrative purposes only, implantable devices will be used in the examples described herein.

Figure 1:
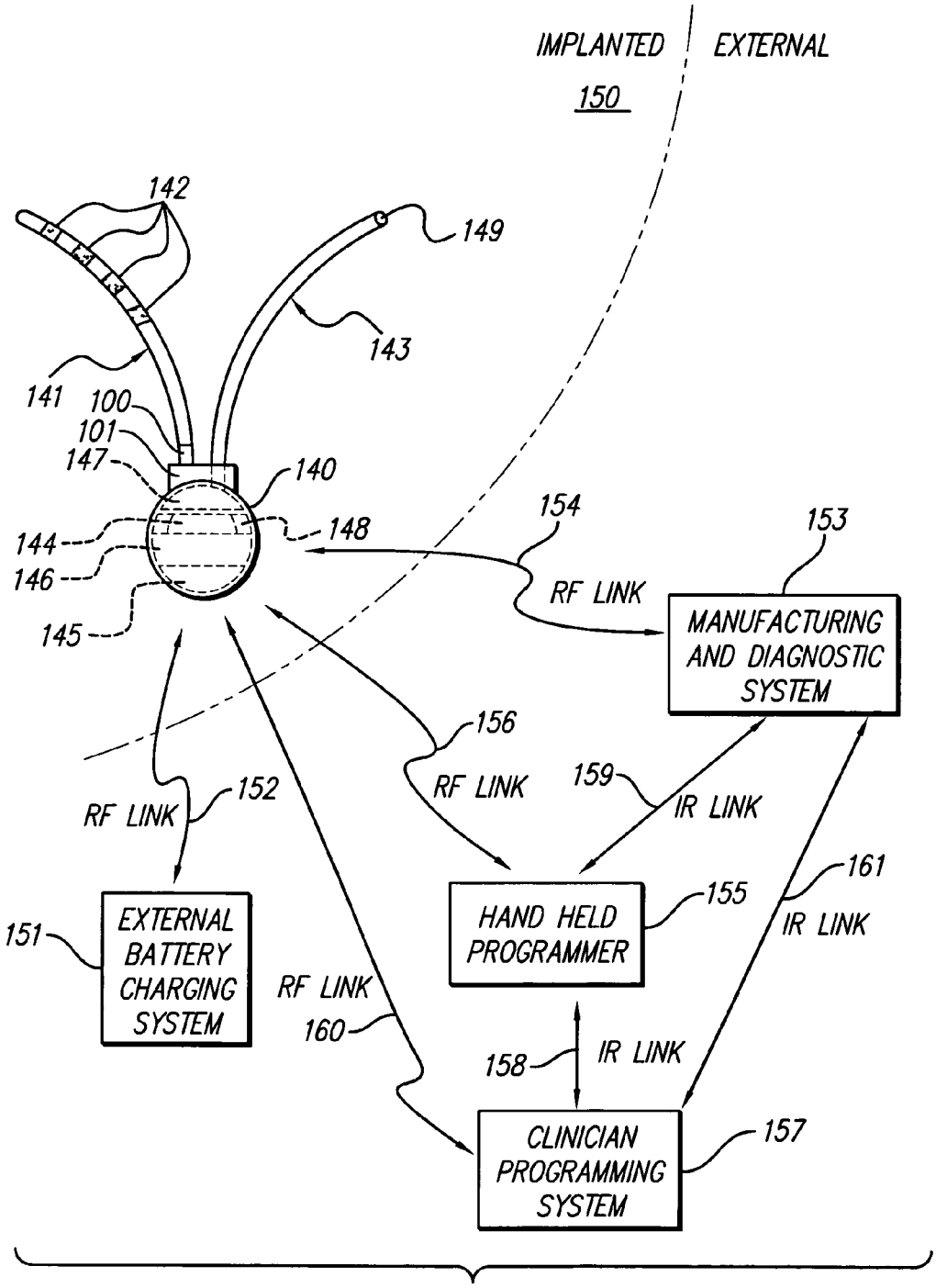
FIG. 1 illustrates an exemplary implantable device that may be used with one or more connector assemblies according to principles described herein.

To facilitate an understanding of an exemplary implantable medical device with which the connector assemblies described herein may be used, an exemplary implantable stimulator will now be described in connection with FIG. 1. FIG. 1 illustrates an implantable stimulator (140) that may be implanted within a patient (150) and used to apply a stimulus to a stimulation site, e.g., an electrical stimulation of the stimulation site, an infusion of one or more drugs at the stimulation site, or both. The electrical stimulation function of the stimulator (140) will be described first, followed by an explanation of the possible drug delivery function of the stimulator (140). It will be understood, however, that the stimulator (140) may be configured to provide only electrical stimulation, only a drug stimulation, both types of stimulation or any other type of stimulation as best suits a particular patient.

The exemplary stimulator (140) shown in FIG. 1 is configured to provide electrical stimulation to a stimulation site via a lead (141) having a number of electrodes (142) disposed thereon. The lead (141) may include any number of electrodes (142) as best serves a particular application. The electrodes (142) may be arranged as an array, for example, having at least two or at least four collinear electrodes. In some embodiments, the electrodes are alternatively inductively coupled to the stimulator (140). The lead (141) may be thin (e.g., less than 3 millimeters in diameter) such that the lead (141) may be positioned near a stimulation site. In some alternative examples, the stimulator (140) is leadless.

As shown in FIG. 1, the lead (141) may include at its proximal end a first connector assembly (100) configured to mate with a second connector assembly (101) that is a part of the stimulator (140). In this manner, the lead (141) may be electrically coupled to the stimulator (140). The stimulator (140) may include one or more additional or alternative connector assemblies configured to connect to one or more other devices. The connector assemblies (100, 101) will be described in more detail below.

As illustrated in FIG. 1, the stimulator (140) includes a number of components. It will be recognized that the stimulator (140) may include additional or alternative components as best serves a particular application. A power source (145) is configured to output voltage used to supply the various components within the stimulator (140) with power and/or to generate the power used for electrical stimulation. The power source (145) may be a primary battery, a rechargeable battery, super capacitor, a nuclear battery, a mechanical resonator, an infrared collector (receiving, e.g., infrared energy through the skin), a thermally-powered energy source (where, e.g., memory-shaped alloys exposed to a minimal temperature difference generate power), a flexural powered energy source (where a flexible section subject to flexural forces is part of the stimulator), a bioenergy power source (where a chemical reaction provides an energy source), a fuel cell, a bioelectrical cell (where two or more electrodes use tissue-generated potentials and currents to capture energy and convert it to useable power), an osmotic pressure pump (where mechanical energy is generated due to fluid ingress), or the like. Alternatively, the stimulator (140) may include one or more components configured to receive power from another medical device that is implanted within the patient.

When the power source (145) is a battery, it may be a lithium-ion battery or other suitable type of battery. When the power source (145) is a rechargeable battery, it may be recharged from an external system through a power link such as a radio frequency (RF) power link or a wire connection. One type of rechargeable battery that may be used is described in International Publication WO 01/82398 A1, published Nov. 1, 2001, and/or WO 03/005465 A1, published Jan. 16, 2003, both of which are incorporated herein by reference in their respective entireties. Other battery construction techniques that may be used to make a power source (145) include those shown, e.g., in U.S. Pat. Nos. 6,280,873; 6,458,171, and U.S. Publications 2001/0046625 A1 and 2001/0053476 A1, all of which are incorporated herein by reference in their respective entireties. Recharging can be performed using an external charger.

The stimulator (140) may also include a coil (148) configured to receive and/or emit a magnetic field (also referred to as a radio frequency (RF) field) that is used to communicate with, or receive power from, one or more external devices (151, 153, 155). Such communication and/or power transfer may include, but is not limited to, transcutaneously receiving data from the external device, transmitting data to the external device, and/or receiving power used to recharge the power source (145).

For example, an external battery charging system (EBCS) (151) may provide power used to recharge the power source (145) via an RF link (152). Additionally or alternatively, the EBCS (151) may provide power to the power source (145) via a direct wire link (not shown). External devices including, but not limited to, a hand held programmer (HHP) (155), clinician programming system (CPS) (157), and/or a manufacturing and diagnostic system (MDS) (153) may be configured to activate, deactivate, program, and test the stimulator (140) via one or more RF links (154, 156). It will be recognized that the links, which are RF links (152, 154, 156) in the illustrated example, may be any type of link used to transmit data or energy, such as an optical link, a thermal link, or any other energy-coupling link. One or more of these external devices (153, 155, 157) may also be used to control the infusion of one or more drugs into the stimulation site.

Additionally, if multiple external devices are used in the treatment of a patient, there may be some communication among those external devices, as well as with the implanted stimulator (140). Again, any type of link for transmitting data or energy may be used among the various devices illustrated. For example, the CPS (157) may communicate with the HHP (155) via an infrared (IR) link (158), with the MDS (153) via an IR link (161), and/or directly with the stimulator (140) via an RF link (160). As indicated, these communication links (158, 161, 160) are not necessarily limited to IR and RF links and may include any other type of communication link. Likewise, the MDS (153) may communicate with the HHP (155) via an IR link (159) or via any other suitable communication link.

The HHP (155), MDS (153), CPS (157), and EBCS (151) are merely illustrative of the many different external devices that may be used in connection with the stimulator (140). Furthermore, it will be recognized that the functions performed by any two or more of the HHP (155), MDS (153), CPS (157), and EBCS (151) may be performed by a single external device. One or more of the external devices (153, 155, 157) may be embedded in a seat cushion, mattress cover, pillow, garment, belt, strap, pouch, or the like so as to be positioned near the implanted stimulator (140) when in use.

The stimulator (140) may also include electrical circuitry (144) configured to produce electrical stimulation pulses that are delivered to the stimulation site via the electrodes (142). In some embodiments, the stimulator (140) may be configured to produce monopolar stimulation. The stimulator (140) may alternatively or additionally be configured to produce multipolar stimulation including, but not limited to, bipolar or tripolar stimulation.

The electrical circuitry (144) may include one or more processors configured to decode stimulation parameters and generate the stimulation pulses. In some embodiments, the stimulator (140) has at least four channels and drives up to sixteen electrodes or more. The electrical circuitry (144) may include additional circuitry such as capacitors, integrated circuits, resistors, coils, and the like configured to perform a variety of functions as best serves a particular application.

The stimulator (140) may also include a programmable memory unit (146) for storing one or more sets of data and/or stimulation parameters. The stimulation parameters may include, but are not limited to, electrical stimulation parameters, drug stimulation parameters, and other types of stimulation parameters. The programmable memory (146) allows a patient, clinician, or other user of the stimulator (140) to adjust the stimulation parameters such that the stimulation applied by the stimulator (140) is safe and efficacious for treatment of a particular patient. The different types of stimulation parameters (e.g., electrical stimulation parameters and drug stimulation parameters) may be controlled independently. However, in some instances, the different types of stimulation parameters are coupled. For example, electrical stimulation may be programmed to occur only during drug stimulation or vice versa. Alternatively, the different types of stimulation may be applied at different times or with only some overlap. The programmable memory (146) may be any type of memory unit such as, but not limited to, random access memory (RAM), static RAM (SRAM), a hard drive, or the like.

The electrical stimulation parameters may control various parameters of the stimulation current applied to a stimulation site including, but not limited to, the frequency, pulse width, amplitude, waveform (e.g., square or sinusoidal), electrode configuration (i.e., anode-cathode assignment), burst pattern (e.g., burst on time and burst off time), duty cycle or burst repeat interval, ramp on time, and ramp off time of the stimulation current that is applied to the stimulation site. The drug stimulation parameters may control various parameters including, but not limited to, the amount of drugs infused at the stimulation site, the rate of drug infusion, and the frequency of drug infusion. For example, the drug stimulation parameters may cause the drug infusion rate to be intermittent, constant, or bolus. Other stimulation parameters that characterize other classes of stimuli are possible. For example, when tissue is stimulated using electromagnetic radiation, the stimulation parameters may characterize the intensity, wavelength, and timing of the electromagnetic radiation stimuli. When tissue is stimulated using mechanical stimuli, the stimulation parameters may characterize the pressure, displacement, frequency, and timing of the mechanical stimuli.

Specific stimulation parameters may have different effects on different stimulation sites and/or different patients. Thus, in some embodiments, the stimulation parameters may be adjusted by the patient, a clinician, or other user of the stimulator (140) as best serves the particular stimulation site or patient being treated. The stimulation parameters may also be automatically adjusted by the stimulator (140), as will be described below. For example, the stimulator (140) may increase excitement of a stimulation site, for example, by applying a stimulation current having a relatively low frequency (e.g., less than 100 Hz). The stimulator (140) may also decrease excitement of a stimulation site by applying a relatively high frequency (e.g., greater than 100 Hz). The stimulator (140) may also, or alternatively, be programmed to apply the stimulation current to a stimulation site intermittently or continuously.

Additionally, the exemplary stimulator (140) shown in FIG. 1 is configured to apply one or more drugs at a stimulation site within a patient. For this purpose, a pump (147) may also be included within the stimulator (140). The pump (147) is configured to store and dispense one or more drugs, for example, through a catheter (143). The catheter (143) is coupled at a proximal end to the stimulator (140) and may have an infusion outlet (149) for infusing dosages of the one or more drugs at the stimulation site. In some embodiments, the stimulator (140) may include multiple catheters (143) and/or pumps (147) for storing and infusing dosages of the one or more drugs at the stimulation site.

The pump (147) or controlled drug release device described herein may include any of a variety of different drug delivery systems. Controlled drug release devices based upon a mechanical or electromechanical infusion pump may be used. In other examples, the controlled drug release device can include a diffusion-based delivery system, e.g., erosion-based delivery systems (e.g., polymer-impregnated with drug placed within a drug-impermeable reservoir in communication with the drug delivery conduit of a catheter), electrodiffusion systems, and the like. Another example is a convective drug delivery system, e.g., systems based upon electroosmosis, vapor pressure pumps, electrolytic pumps, effervescent pumps, piezoelectric pumps and osmotic pumps. Another example is a micro-drug pump.

Exemplary pumps (147) or controlled drug release devices suitable for use as described herein include, but are not necessarily limited to, those disclosed in U.S. Pat. Nos. 3,760,984; 3,845,770; 3,916,899; 3,923,426; 3,987,790; 3,995,631; 3,916,899; 4,016,880; 4,036,228; 4,111,202; 4,111,203; 4,203,440; 4,203,442; 4,210,139; 4,327,725; 4,360,019; 4,487,603; 4,627,850; 4,692,147; 4,725,852; 4,865,845; 5,057,318; 5,059,423; 5,112,614; 5,137,727; 5,234,692; 5,234,693; 5,728,396; 6,368,315 and the like.

Additional exemplary drug pumps suitable for use as described herein include, but are not necessarily limited to, those disclosed in U.S. Pat. Nos. 4,562,751; 4,678,408; 4,685,903; 5,080,653; 5,097,122; 6,740,072; and 6,770,067. Exemplary micro-drug pumps suitable for use as described herein include, but are not necessarily limited to, those disclosed in U.S. Pat. Nos. 5,234,692; 5,234,693; 5,728,396; 6,368,315; 6,666,845; and 6,620,151. All of these listed patents are incorporated herein by reference in their respective entireties.

In some embodiments, the one or more drugs are infused chronically into the stimulation site. Additionally or alternatively, the one or more drugs may be infused acutely into the stimulation site in response to a biological signal or a sensed need for the one or more drugs.

The stimulator (140) of FIG. 1 is illustrative of many types of stimulators that may be used to apply a stimulus to a stimulation site. For example, the stimulator (140) may include an implantable pulse generator (IPG) coupled to one or more leads having a number of electrodes, a spinal cord stimulator (SCS), a cochlear implant, a deep brain stimulator, a drug pump (mentioned previously), a micro-drug pump (mentioned previously), or any other type of implantable stimulator configured to deliver a stimulus at a stimulation site within a patient. Exemplary IPGs suitable for use as described herein include, but are not limited to, those disclosed in U.S. Pat. Nos. 6,381,496; 6,553,263; and 6,760,626. Exemplary spinal cord stimulators suitable for use as described herein include, but are not limited to, those disclosed in U.S. Pat. Nos. 5,501,703; 6,487,446; and 6,516,227. Exemplary cochlear implants suitable for use as described herein include, but are not limited to, those disclosed in U.S. Pat. Nos. 6,219,580; 6,272,382; and 6,308,101. Exemplary deep brain stimulators suitable for use as described herein include, but are not limited to, those disclosed in U.S. Pat. Nos. 5,938,688; 6,016,449; and 6,539,263. All of these listed patents are incorporated herein by reference in their respective entireties.

Alternatively, the stimulator (140) may include an implantable microstimulator, such as a BION® microstimulator (Advanced Bionics® Corporation, Valencia, Calif.). Various details associated with the manufacture, operation, and use of implantable microstimulators are disclosed in U.S. Pat. Nos. 5,193,539; 5,193,540; 5,312,439; 6,185,452; 6,164,284; 6,208,894; and 6,051,017. All of these listed patents are incorporated herein by reference in their respective entireties.

Figure 2:
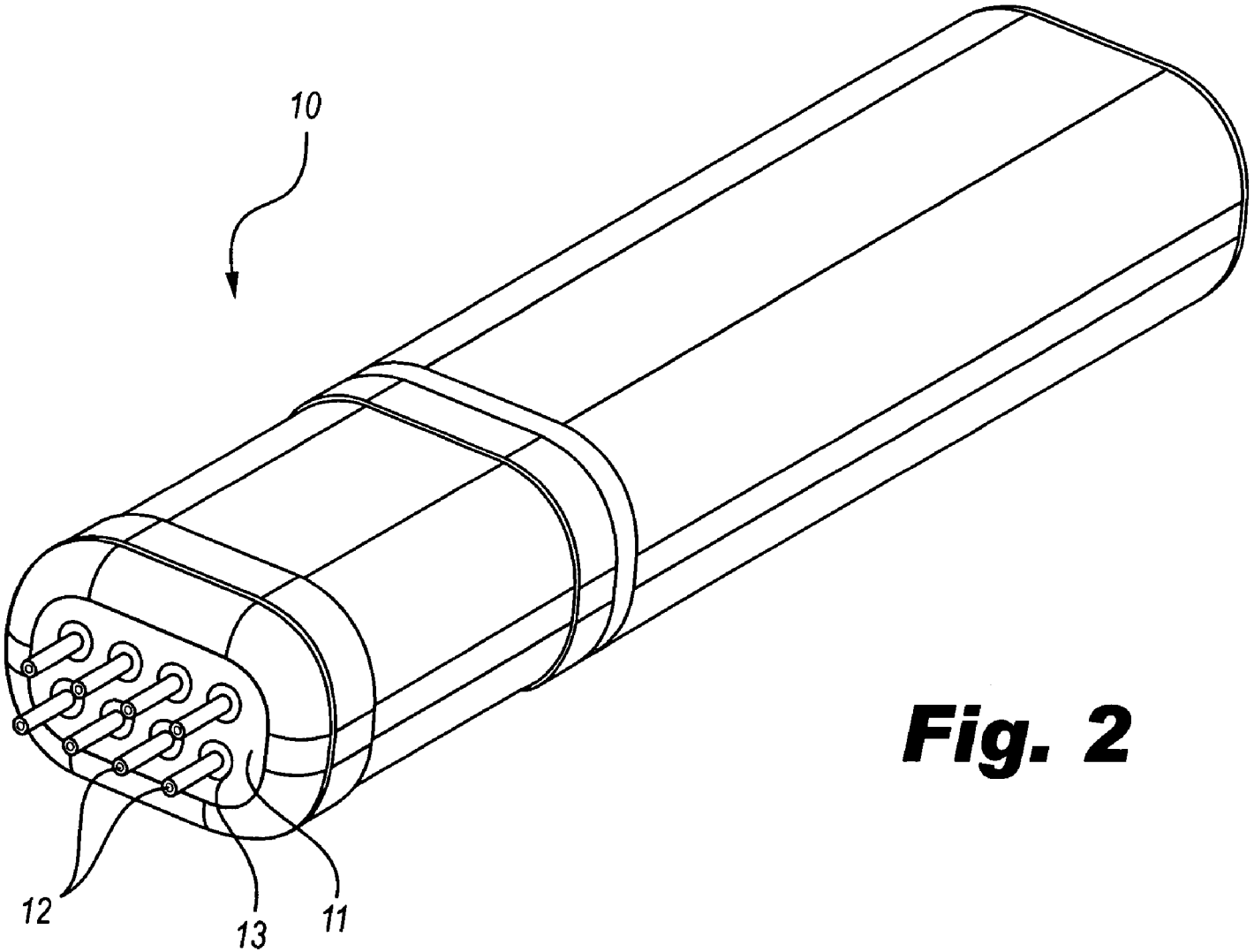
FIG. 2 is a perspective view of an exemplary implantable device having a pin array connector assembly disposed at one of its ends according to principles described herein.

FIG. 2 illustrates an exemplary implantable device (10) having a pin array connector assembly (11) disposed at one of its ends. The implantable device (10) may include a stimulator, cable, lead, or any other device configured to be implanted within a patient. The pin array connector assembly (11) may include any number of spaced pins (12) as best serves a particular application. The pin array connector assembly (11) may also include an insulative housing (13) configured to hold the pins (12) in place and prevent aberrant electrical contact between the pins (12) and/or electrical circuitry within the device (10).

Each pin (12) may be electrically coupled to electronic circuitry located within the implantable device (10) and may be made out of any suitable conductive metal. Moreover, each pin (12) may have any suitable shape and size as best serves a particular application.

As with all manufactured parts, the dimensions of the pins (12) and the spacing between the pins (12) are subject to variation within a prescribed tolerance. With small pin array connector assemblies, such as those used with implantable medical devices, such variation in dimension and spacing may create undesirable stress, aberrant electrical contact, and/or device malfunction. Moreover, the pins (12) are often fragile and therefore easily misaligned, bent, or broken, especially over time.

Figure 3:
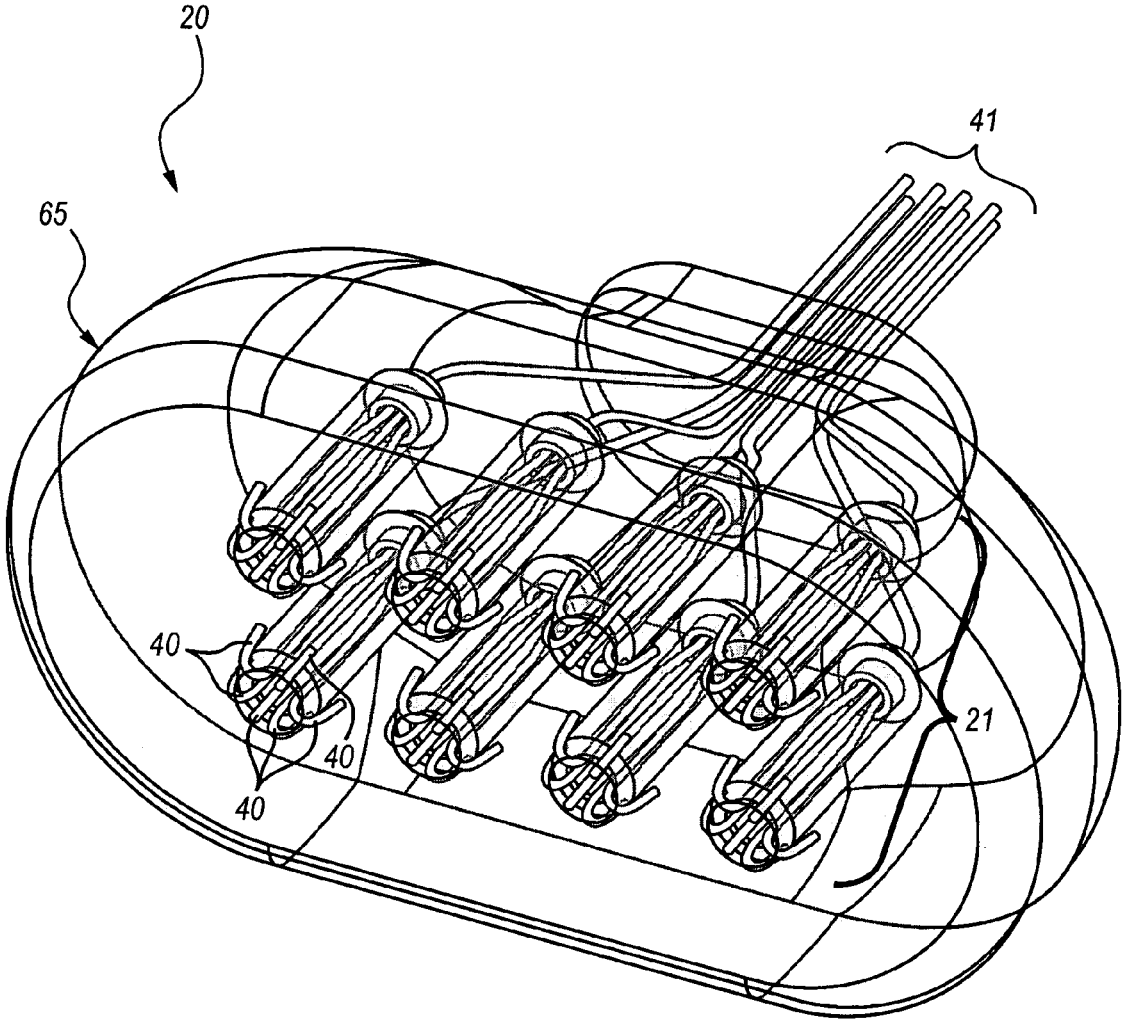
FIG. 3 is a wireframe perspective view of an exemplary receptacle connector assembly that is configured to mate with the pin array connector assembly of FIG. 2 according to principles described herein.

Hence, a receptacle connector assembly that can conform to the dimensional and spacing variations of the pins (12) will be described herein. FIG. 3 is a wireframe perspective view of an exemplary receptacle connector assembly (20) that is configured to mate with a pin array connector assembly (11) like that of FIG. 2. As shown in FIG. 3, the receptacle connector assembly (20) includes a number of socket assemblies (21) or recessed holes housed within a housing (65). Each socket assembly (21) includes a number of uninsulated conductive wires (40) disposed therein for making electrical contact with a corresponding pin (12; FIG. 2). A number of insulated conductive wires (41) are also included within the receptacle connector assembly (11) and are used to electrically couple the socket assemblies (21) to electronic circuitry within a device or electrode assembly of which the receptacle connector assembly (20) is a part.

As will be described in more detail, each socket assembly (21) is constructed such that a corresponding pin (12; FIG. 2) may be inserted securely therein to ensure a reliable physical and electrical connection. Moreover, the receptacle connector assembly (20) described herein is compliant and flexible so that it can tolerate a misaligned pin array and/or dimension tolerance stack-up resulting from manufacturing variations. The components of the receptacle connector assembly (20) will be described in more detail below.

In some examples, the flexible socket opening of each socket assembly (21) is elastic in nature and smaller in diameter compared to its corresponding pin (12; FIG. 2). This elasticity allows one or more of the multiple wires within the socket assembly (21) to make contact with the pin (12; FIG. 2). Additionally or alternatively, the elasticity serves to seal or insulate the connection between the socket assemblies (21) and pins (12; FIG. 2).

An exemplary method of making the receptacle connector assembly (20) will now be described in connection with FIGS. 4-13. First, each socket assembly (21) is formed using the steps that will be described in connection with FIGS. 4-8.

Figure 4:
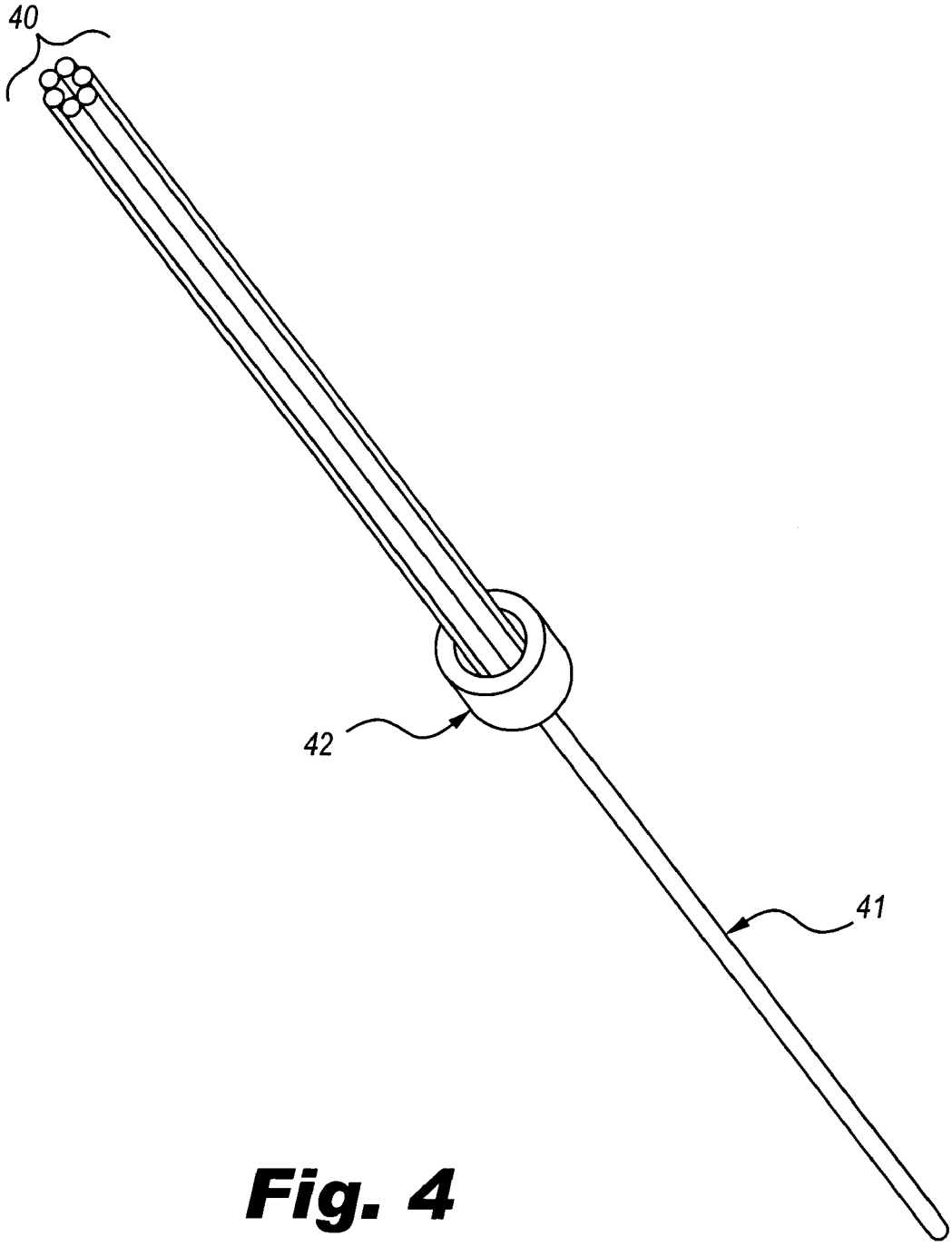
FIG. 4 is a perspective view of a bundle of uninsulated conductive wires that is conductively joined together at one of its ends to a single conductive wire that extends in an opposite direction along a longitudinal axis according to principles described herein.

As shown in FIG. 4, a bundle of uninsulated conductive wires (40) is first conductively joined together at one of its ends to a single conductive wire (41) that extends in an opposite direction along a longitudinal axis. The bundle of uninsulated wires (40) may include any number of wires as best serves a particular application. However, for illustrative purposes only, FIG. 4 shows six bundled uninsulated wires (40). Also, as will be described in more detail below, a portion of the single wire (41) may be uninsulated, while a remaining portion of the single wire (41) may be at least partially insulated.

Each of the conductive wires (40, 41) may be made of a noble or refractory metal or compound such as, but not limited to, platinum, iridium, tantalum, titanium, titanium nitride, stainless steel, nickel, niobium or alloys of any of these. Moreover, each of the conductive wires (40, 41) may have any diameter as best serves a particular application. For example, each wire (40, 41) may have a diameter of 0.002 inches when used in a receptacle connector assembly for a small implantable device.

In some examples, the bundle of uninsulated wires (40) is conductively joined to the single wire (41) by placing a small section of conductive tubing (42) around a proximal portion of the bundle of uninsulated wires (40) and an uninsulated portion of the single wire (41) and then resistance welding the wires (40, 41) and tubing (42) together. However, it will be recognized that the bundle of uninsulated wires (40) and the single wire (41) may be conductively joined using any other method as best serves a particular application. The conductive tubing (42) may have any suitable width and may be made out of a noble or refractory metal or compound such as, but not limited to, platinum, iridium, tantalum, titanium, titanium nitride, stainless steel, nickel, niobium or alloys of any of these. In some alternative embodiments, the tubing (42) may be made out of a non-conductive material.

In some examples, each of the wires (40) within the bundle of wires is flexible. This flexibility allows the wires (40) to be formed into a predetermined shape in the construction of the socket assembly (21; FIG. 3), as will be described in more detail below.

Figure 5:
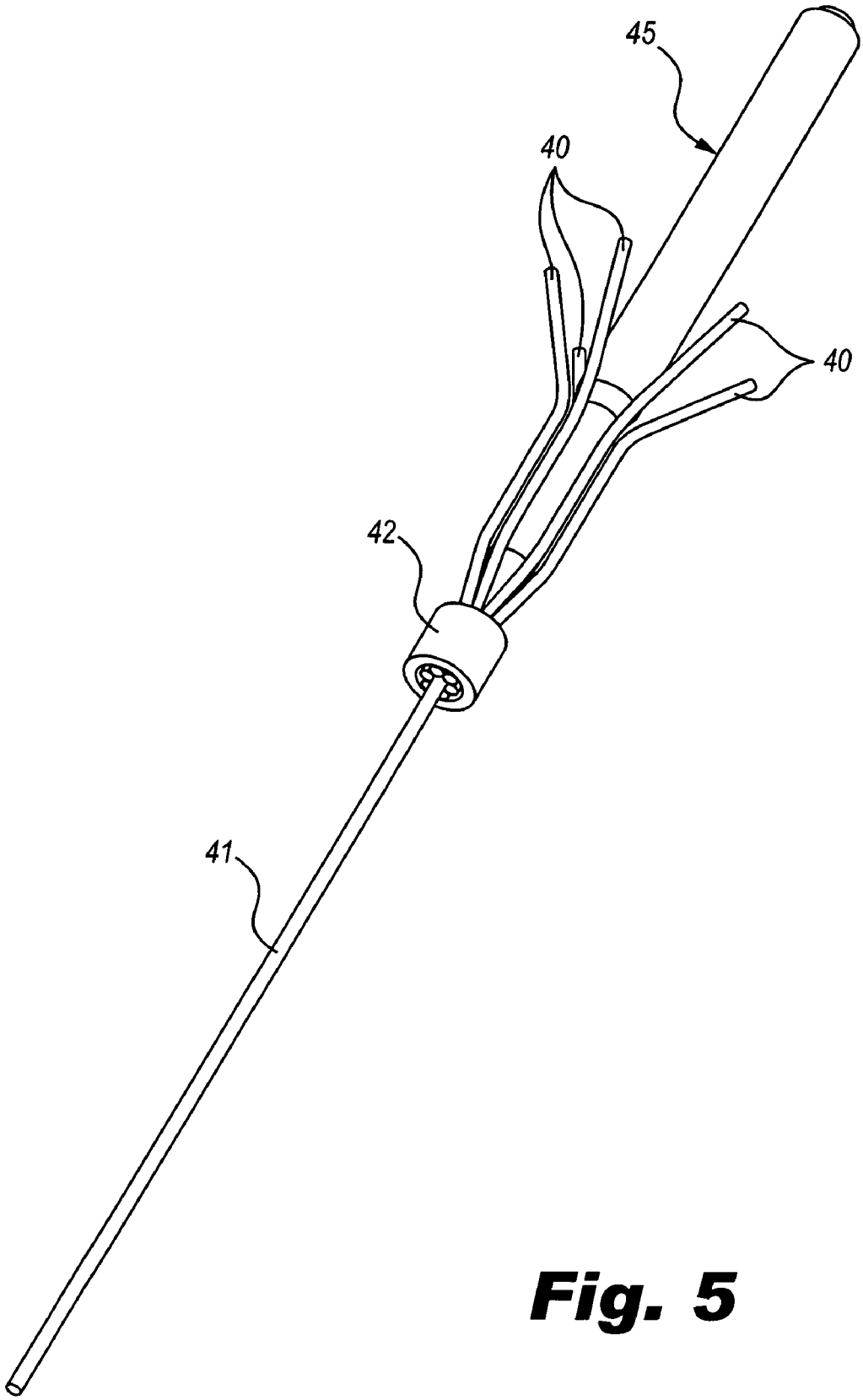
FIG. 5 is a perspective view of a mold pin inserted into the center of the bundle of uninsulated conductive wires according to principles described herein.

Next, as shown in FIG. 5, a mold pin (45) is inserted into the center of the bundle of uninsulated wires (40) to separate the wires (40) such that they form a cavity configured to receive a pin (12; FIG. 2). As shown in FIG. 5, at least a portion of the mold pin (45) is not surrounded by the wires (40).

Figure 6:
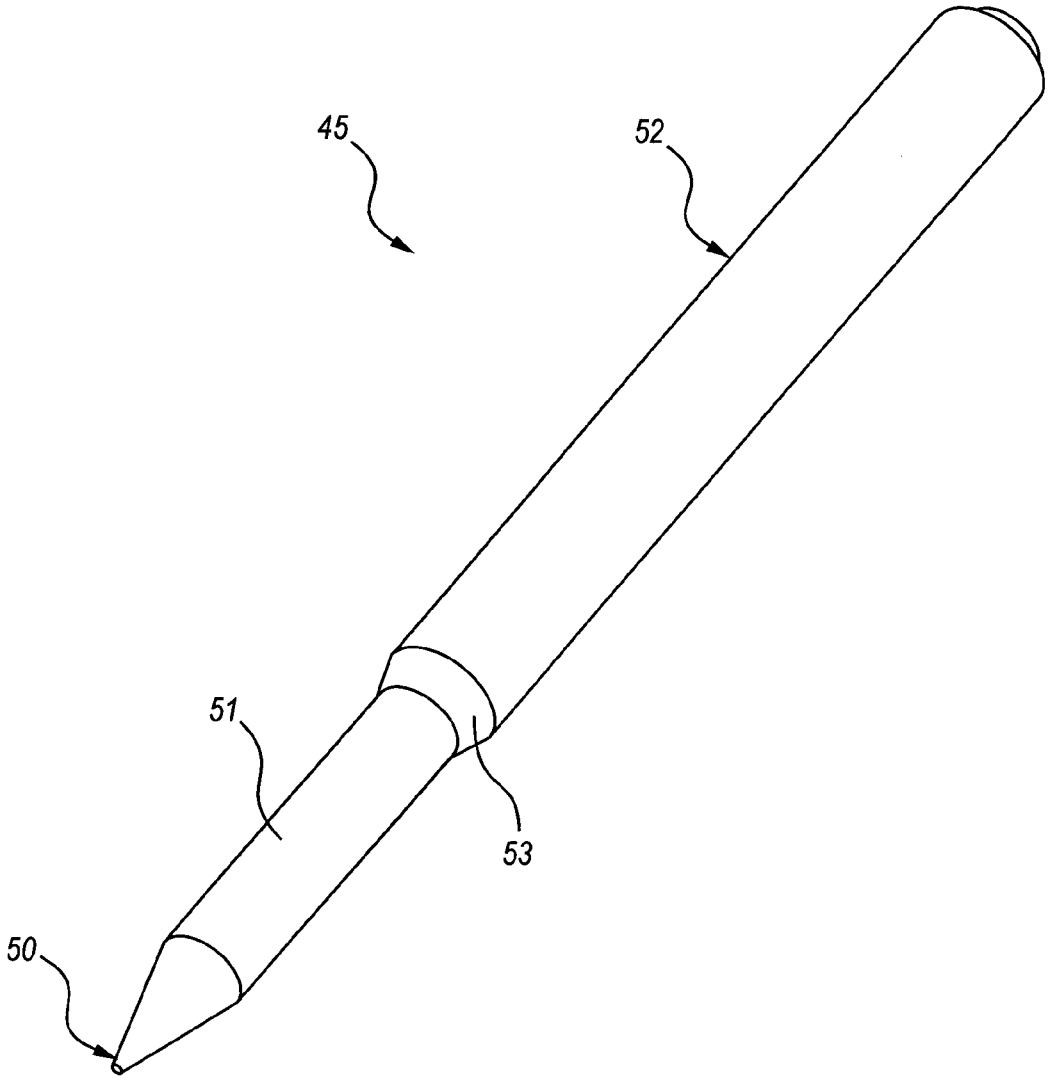
FIG. 6 is a perspective view of an exemplary mold pin according to principles described herein.

FIG. 6 is a perspective view of an exemplary mold pin (45). The mold pin (45) may be made out of any suitable material as best serves a particular application. For example, the mold pin (45) may be made out of stainless steel or plastic.

As shown in FIG. 6, the mold pin (45) has a tapered distal tip (50), a first elongated portion (51), and a second elongated portion (52). The tapered distal tip (50) and first elongated portion (51) are configured to separate and push the wires (40; FIG. 5) out laterally such that they form a cavity or hole configured to receive a pin (12; FIG. 2) that is a part of the pin array connector assembly (11; FIG. 2).

As shown in FIG. 6, the second elongated portion (52) has a larger perimeter than the first elongated portion (51). A sloped portion (53) located between the first and second elongated portions (51, 52) is configured to outwardly bend a distal portion of the wires (40; FIG. 5) when the mold pin (45) is inserted into the center of the bundle of uninsulated wires (40; FIG. 5).

Figure 7A:
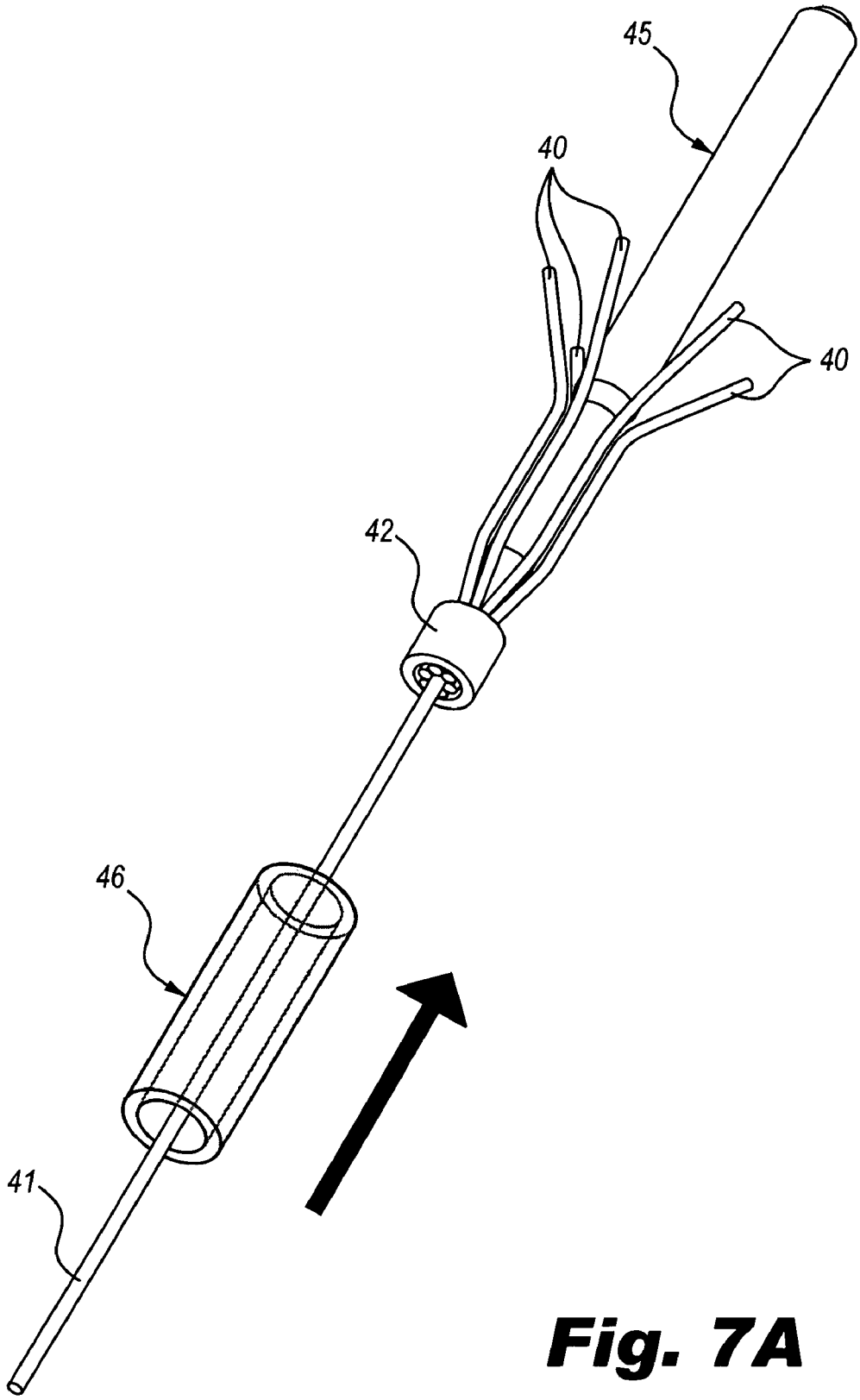
FIGS. 7A-7B are perspective views showing a section of rubber tubing being positioned such that it surrounds a proximal portion of the bundle of uninsulated conductive wires according to principles described herein.
Figure 7B:
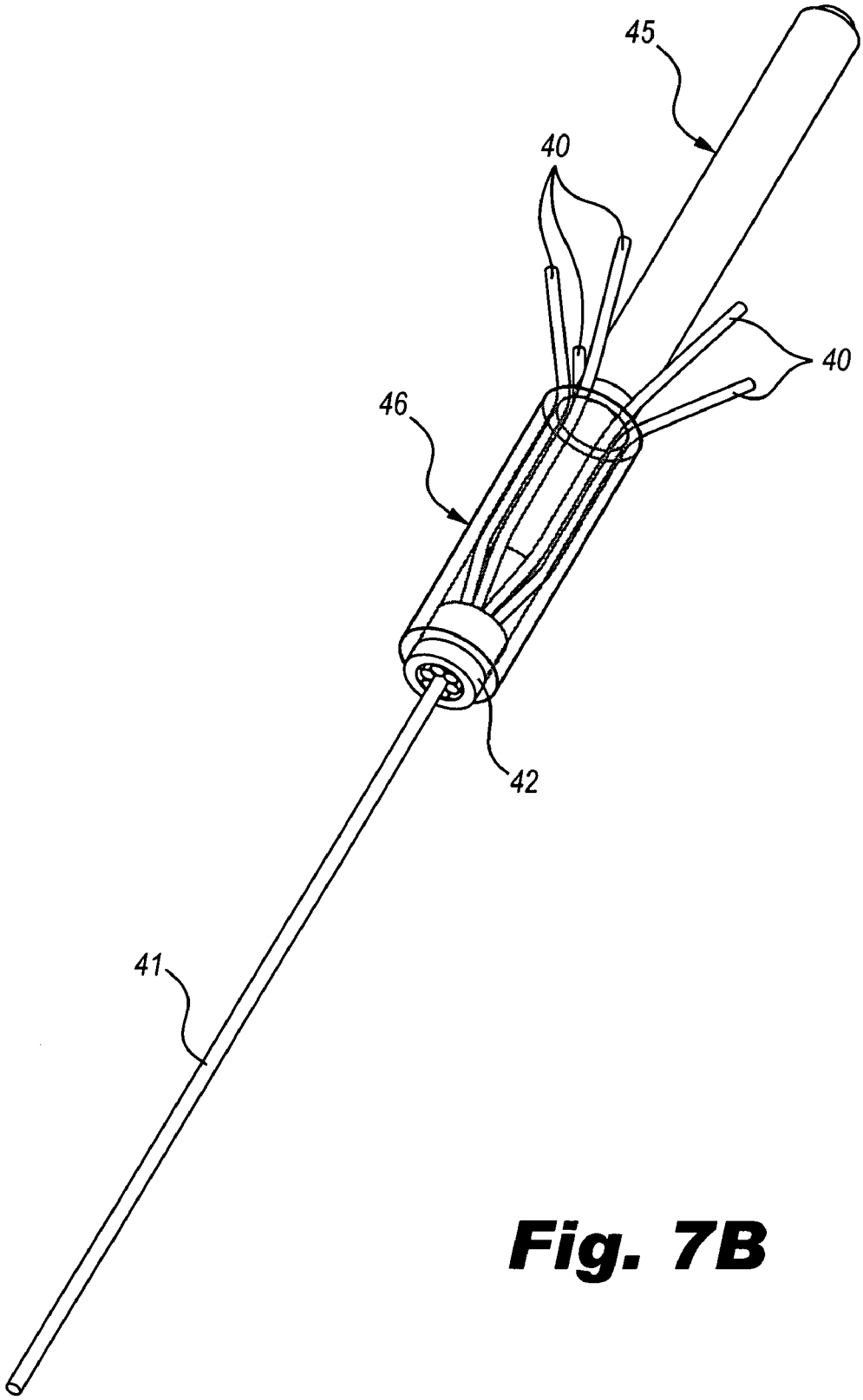

Next, as shown in FIGS. 7A-7B and with the mold pin (45) still inserted within the bundle of wires (40), a sleeve (46) is positioned such that it surrounds a proximal portion of the bundle of wires (40). For example, as shown in FIG. 7A, the sleeve (46) may be slid over the single wire (41) and onto the proximal portion of the bundle of wires (40). As shown in FIG. 7B, the mold pin (45) prevents the wires (40) from bending inwardly while the sleeve (46) is put into position. The sleeve (46) may also at least partially surround the conductive tubing (42), as shown in FIG. 7B.

The sleeve (46) is dimensioned such that it fits securely around the bundle of wires (40) so as to retain the spacing and/or shape of the wires (40). Moreover, the sleeve (46) may be made out of any suitable elastomer such as, but not limited to, silicone rubber, polyurethane rubber, polychloroprene rubber, polyisoprene, and polybutadiene.

As will be described in more detail below, the elasticity of the sleeve (46) allows the receptacle connector assembly (20; FIG. 3) to be more compliant and to mate with a pin array connector having misaligned pins. Moreover, the elasticity of the sleeve (46) reduces the amount of stress placed upon the pins (12; FIG. 2) when mated with the socket assemblies (21).

Figure 8:
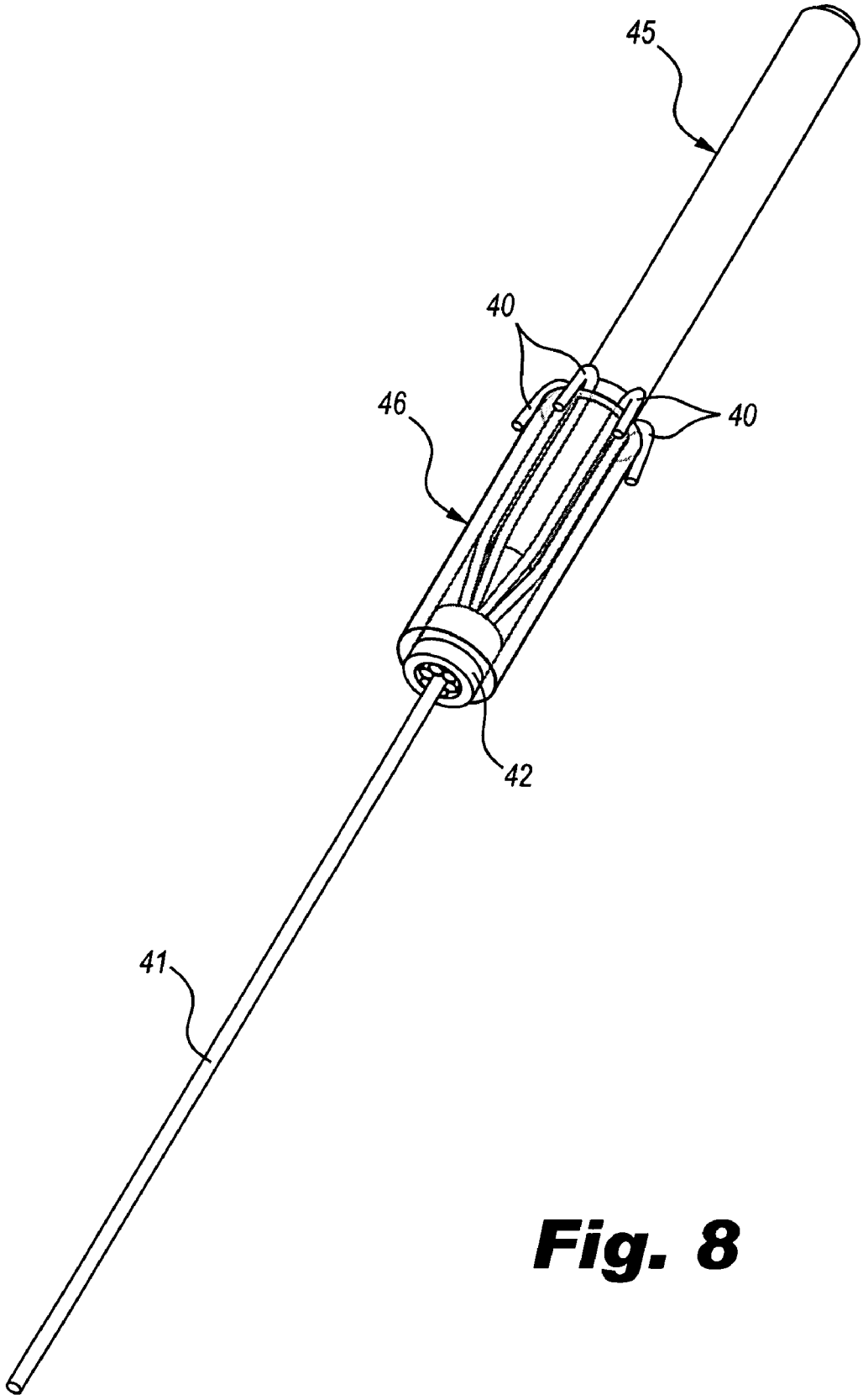
FIG. 8 is a perspective view showing the distal portions of the uninsulated conductive wires folded back against the outer surface of the sleeve according to principles described herein.

As shown in FIG. 7B, a distal portion of the wires (40) remains uncovered by the sleeve (46). In some examples, these distal portions are folded back against the outer surface of the sleeve (46) so as to secure the wires (40) to the sleeve (46), as shown in FIG. 8. The folded wires (40) assist in guiding a pin (12; FIG. 2) into a corresponding socket assembly (21). In some examples, the distal tips of the wires (40) may be cut off so as to reduce the length of the folded back portions to a desired size.

The steps illustrated in connection with FIGS. 4-8 are repeated for each socket assembly (21) within the receptacle connector assembly (20; FIG. 3). Hence, each socket assembly (21) includes a number of uninsulated wires (40) that have been spaced by a mold pin (45) to form a cavity or hole for receiving and making electrical contact with a pin (12; FIG. 2).

The uninsulated wires (40) are conductively joined to a single insulated wire (41) that extends in an opposite direction along a longitudinal axis. Finally, an elastic sleeve (46) surrounds the uninsulated bundle of wires (40). The sleeve (46) serves, in part, to retain the spacing of the uninsulated wires (40).

Once each socket assembly (21) is constructed using the steps shown in FIGS. 4-8, the remaining portions of the receptacle connector assembly (20; FIG. 3) may be constructed. As shown in the perspective side view of FIG. 9A, a portion of each mold pin (45) that is not surrounded by the bundle of wires (40) and sleeve (46) is inserted into a corresponding hole (61) of a mold plate (60). In some examples, the mold pins (45) are inserted into the holes (61) in a manner such that none of the uninsulated wires (40) make contact with the mold plate (60). However, in some alternative examples, one or more of the uninsulated wires (40) may make contact with the mold plate (60).

Figure 10:
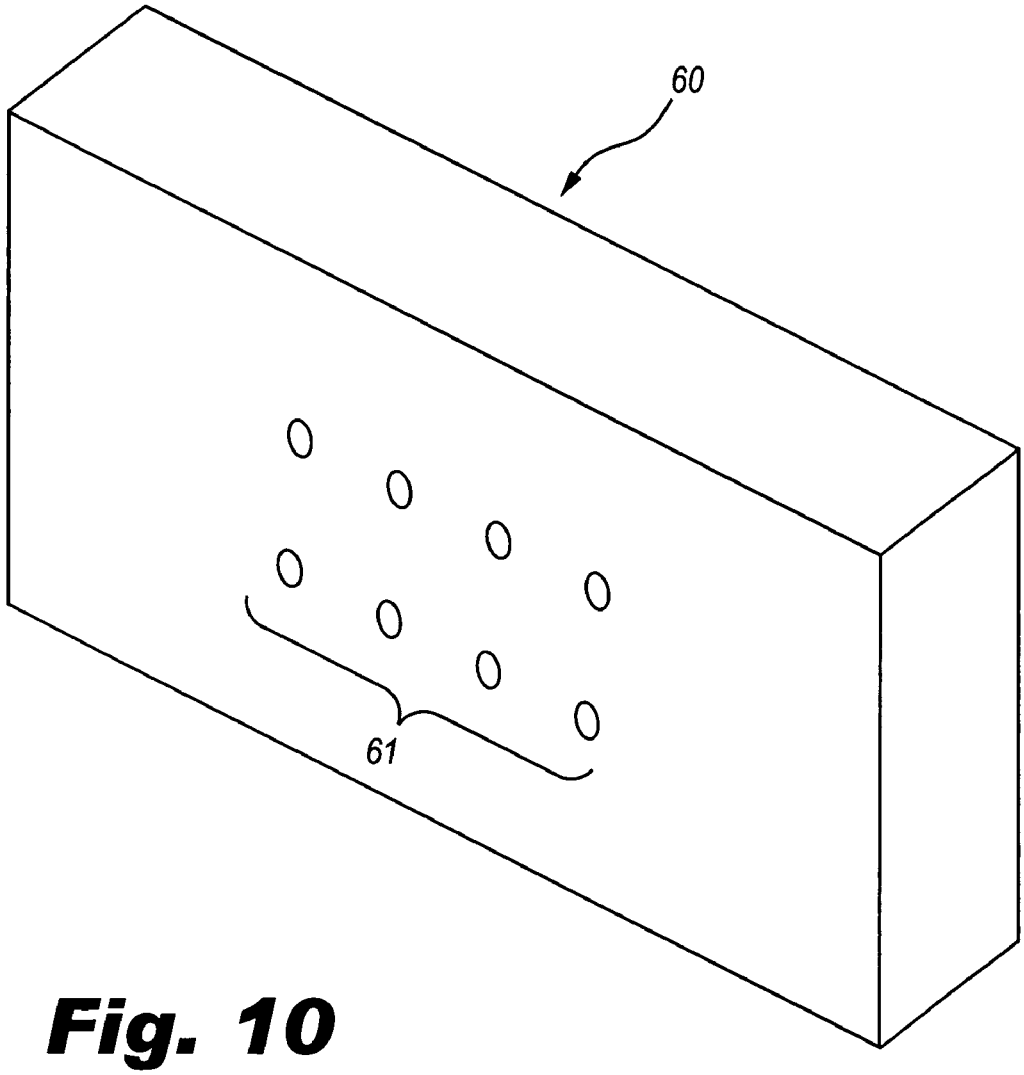
FIG. 10 is a perspective view of an exemplary mold plate according to principles described herein.

FIG. 10 is a perspective view of an exemplary mold plate (60). As shown in FIG. 10, the mold plate (60) has a number of holes (61) arranged in a pattern that matches the pin array pattern of a pin array connector assembly (11; FIG. 2) configured to mate with the receptacle connector assembly (20; FIG. 3). The number of holes (61) may vary as best serves a particular application. In some examples, each hole (61) extends all the way through the mold plate (60). Alternatively, each hole (61) may only partially extend through the mold plate (60) as best serves a particular application.

The mold plate (60) may be made out of any material as best serves a particular application. For example, the mold plate (60) may be made out of a metal (e.g., stainless steel), ceramic, plastic, or any other material.

Figure 9A:
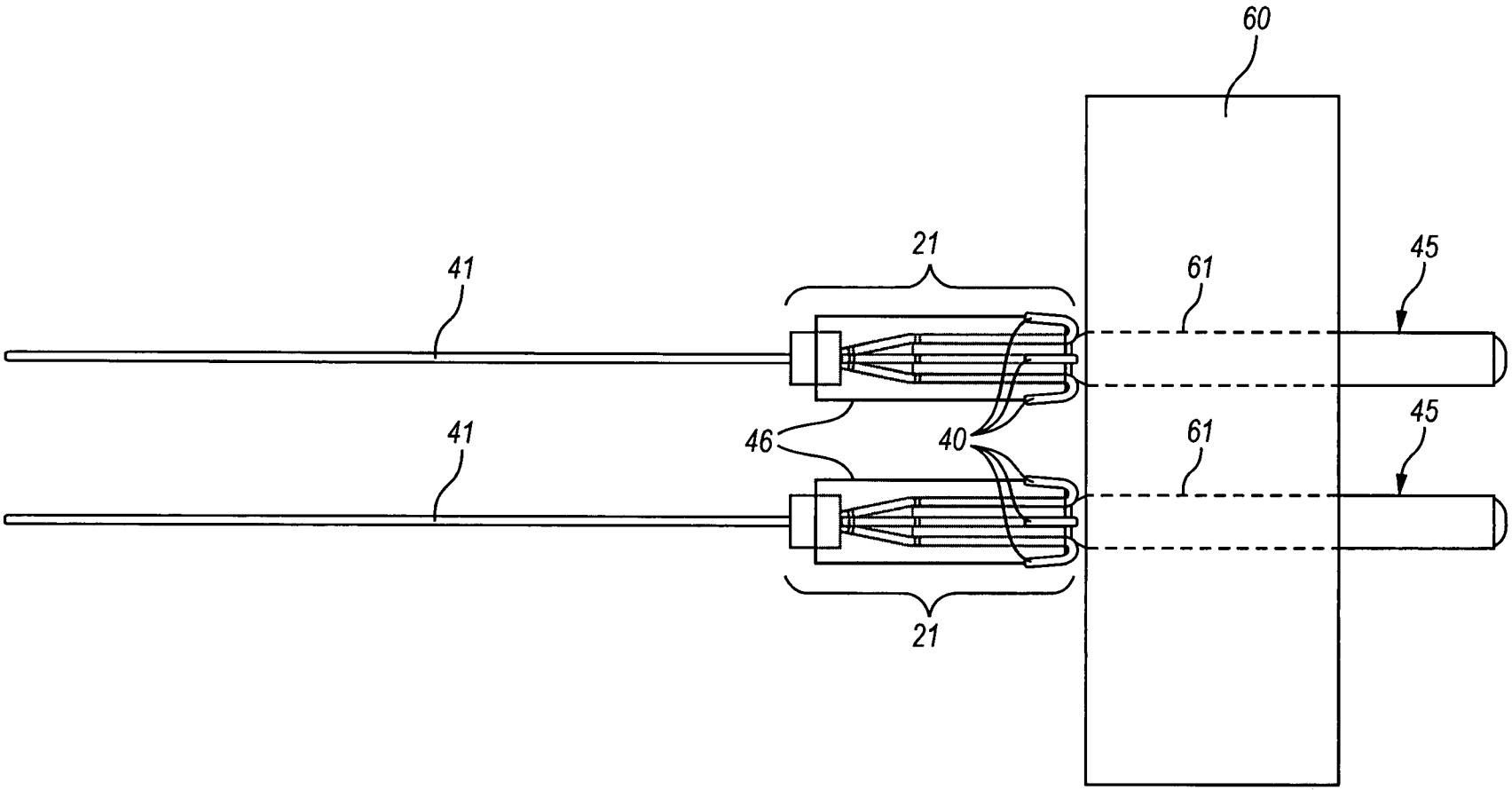
FIG. 9A is a perspective side view of a number of mold pins inserted into corresponding holes within a mold plate according to principles described herein.
Figure 9B:
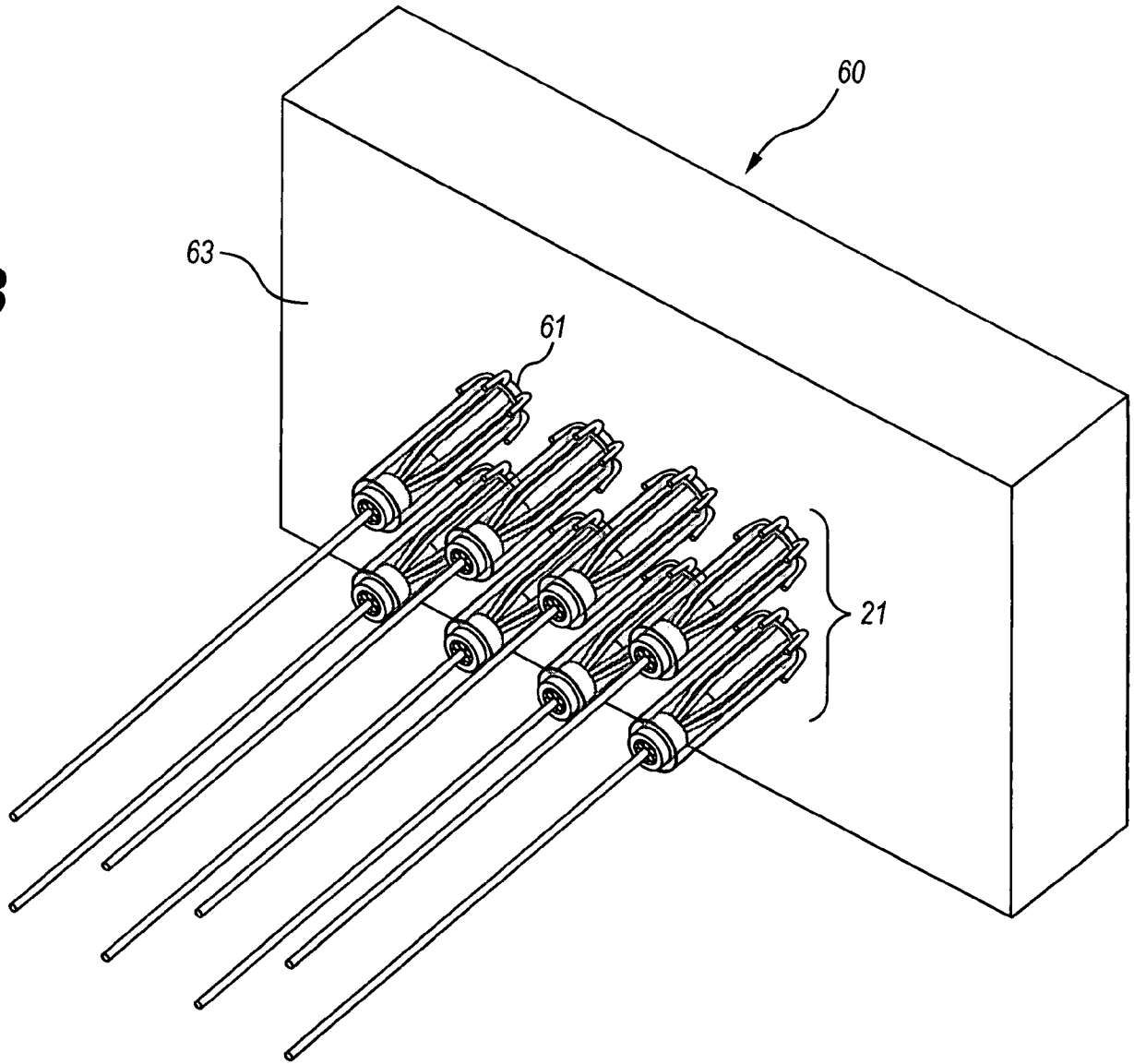
FIG. 9B is a perspective view of the mold plate with the mold pins inserted therein such that the socket assemblies abut the outer surface of the mold plate according to principles described herein.

FIG. 9B is a perspective view of the mold plate (60) with the mold pins (not shown) inserted therein. Eight socket assemblies (21) are shown in FIG. 9B for illustrative purposes only.

Figure 11:
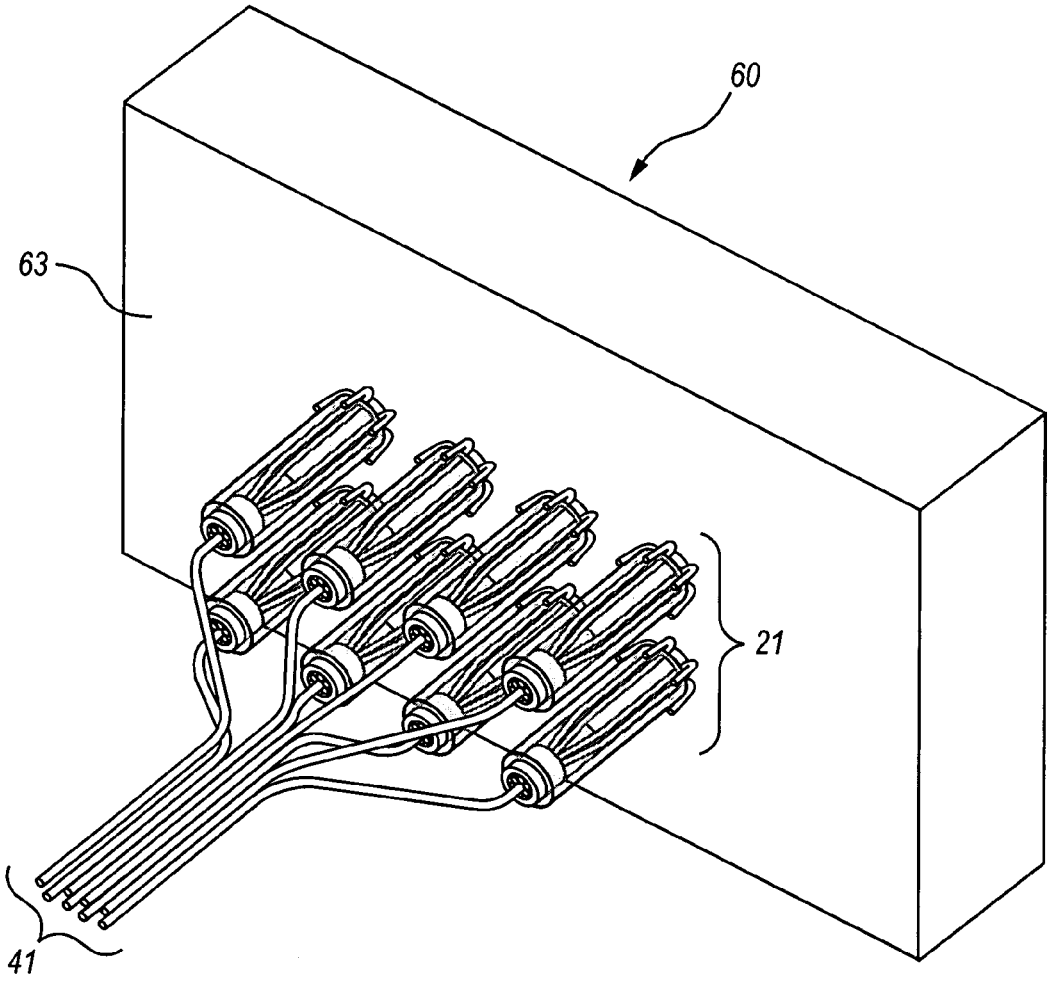
FIG. 11 is a perspective view showing the insulated wires corresponding to each socket assembly gathered together according to principles described herein.

Next, as shown in FIG. 11, the insulated wires (41) corresponding to each socket assembly (21) are gathered together so that an insulative housing may be molded around the group of socket assemblies (21), as will be described in more detail below. The uninsulated wires (40) may be electrically connected to electronic circuitry within a device (e.g., a lead or an electrode assembly that is to be attached to the receptacle connector assembly (20; FIG. 3)). In this manner, each socket assembly (21) may be electrically connected to electronic circuitry within the device.

Figure 12A:
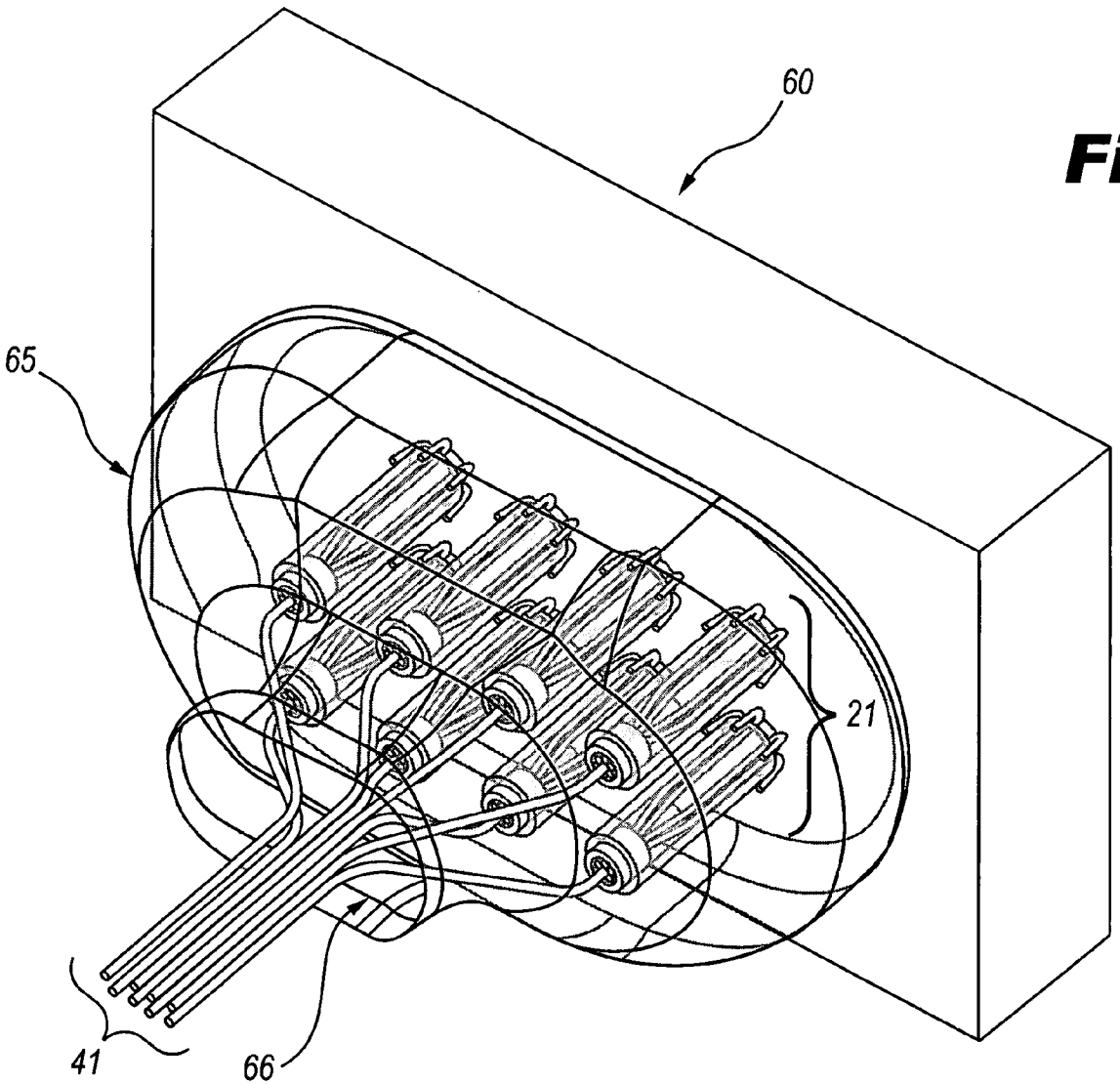
FIG. 12A is a perspective wireframe view of an insulative housing that has been molded around the socket assemblies according to principles described herein.
Figure 12B:
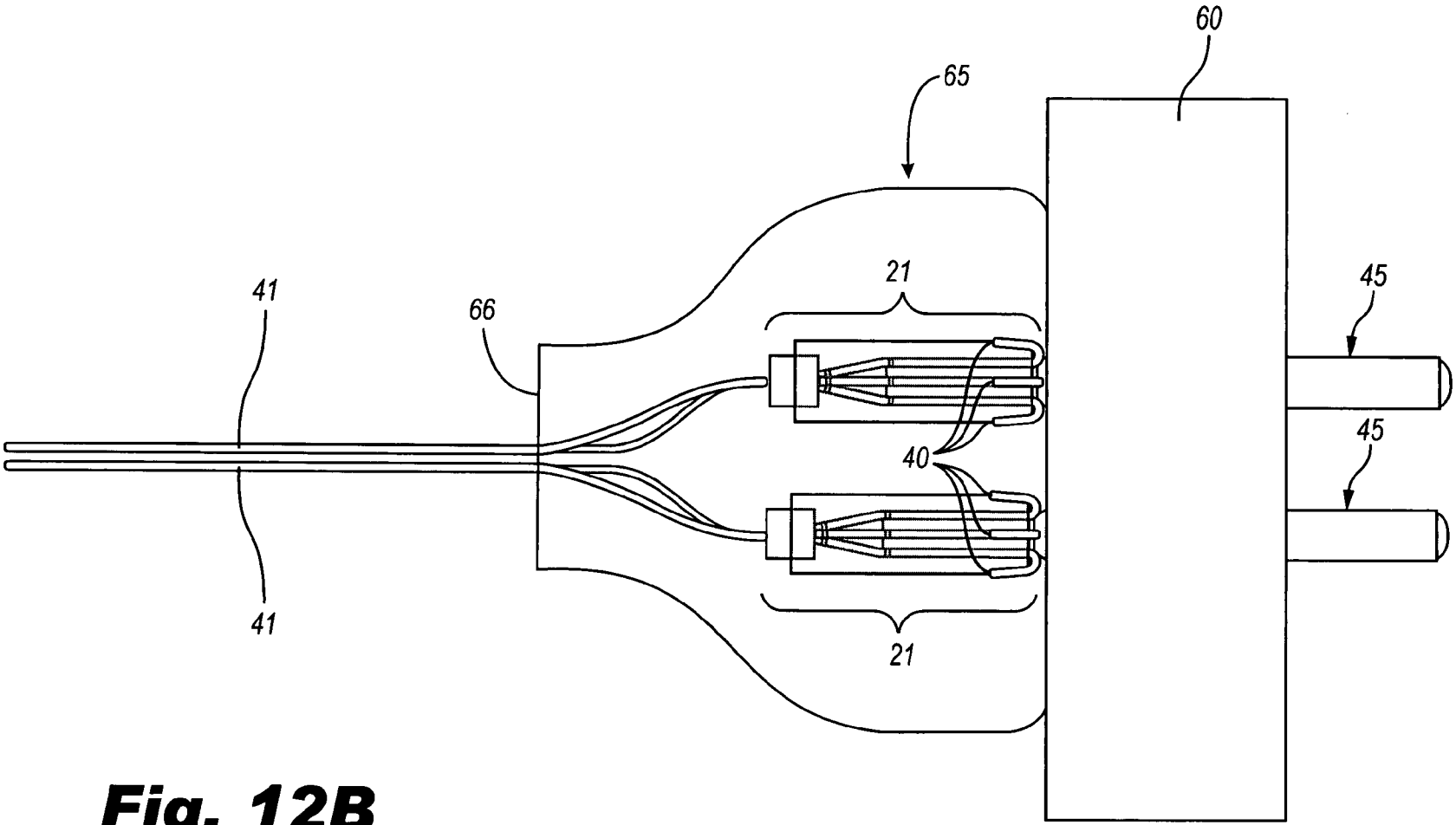
FIG. 12B is a wireframe side view of the insulative housing, mold plate, and socket assemblies according to principles described herein.

The socket assemblies (21) may then be molded into an insulative housing (65), as shown in FIGS. 12A and 12B. FIG. 12A is a perspective wireframe view of an insulative housing (65) that has been molded around the socket assemblies (21). FIG. 12B is a wireframe side view of the insulative housing (65), mold plate (60), and socket assemblies (21). The insulative housing (65) is configured to hold each socket assembly (21) in place so that when the socket assemblies (21) are separated from the mold plate (60), they maintain their proper positioning.

In some examples, as shown in FIGS. 12A and 12B, the insulative housing (65) includes a rear opening (66) through which the insulated wires (41) extend. It will be recognized that the shape of the insulative housing (65) may vary as best serves a particular application.

The insulative housing (65) may be made out of any suitable polymer or elastomer such as, but not limited to, silicone rubber, polyurethane rubber, polychloroprene rubber, polyisoprene, and polybutadiene. In some examples, the material of the insulative housing (65) is the same material as that used for the sleeve (46; FIG. 7B) and/or the tubing (42; FIG. 4) such that after molding, they become one part. The elasticity of the insulative housing (65) allows the receptacle connector assembly (20; FIG. 3) to be compliant and mate with a corresponding pin array connector assembly (11; FIG. 2).

Figure 13:
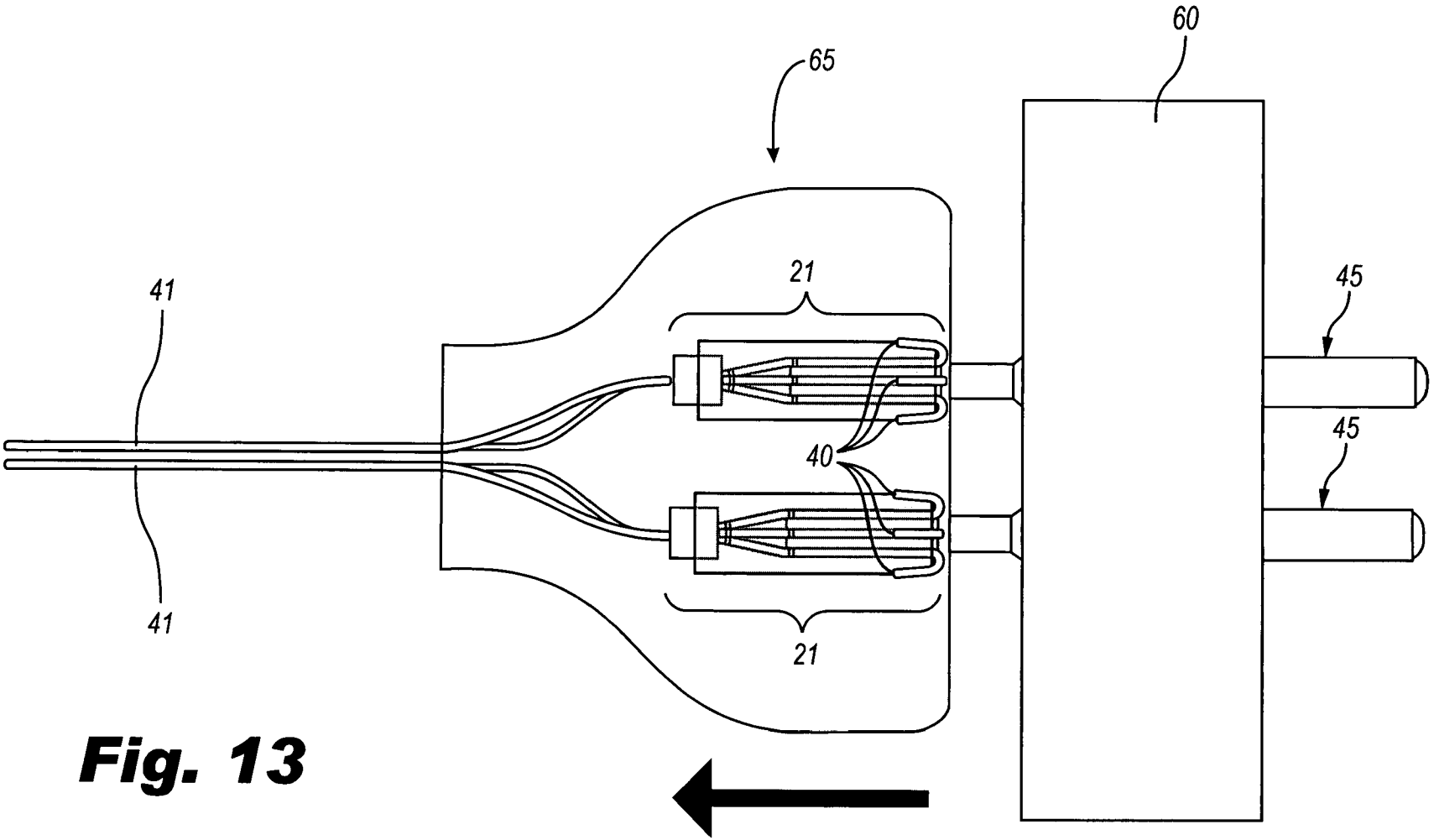
FIG. 13 is a wireframe side view of the insulative housing and socket assemblies being separated from the mold plate and mold pins according to principles described herein.

Next, as shown in the wireframe side view of FIG. 13, the insulative housing (65) and socket assemblies (21) are separated from the mold plate (60) and mold pins (45). In some examples, the mold pins (45) are removed from the socket assemblies (21) after the housing (65) and socket assemblies (21) have been separated from the mold plate (60). Alternatively, the housing (65) and socket assemblies (21) are removed from the mold pins (45) and mold plate (60) simultaneously.

The resultant receptacle connector assembly (20) is shown in FIG. 3. The material of which the housing (65) and sleeve (46; FIG. 7B) are made allows the receptacle connector assembly (20) to be compliant with pin array connector assemblies (11; FIG. 2) having various pin misalignments and/or variations in dimension. Furthermore, the receptacle connector assembly (20) is flexible so that damage to the pins (12; FIG. 2) caused by the mating process and/or normal usage is eliminated or at least minimized. Moreover, the use of multiple flexible wires (40) instead of a rigid wall of metal within each of the socket assemblies (21) reduces undesirable stress on the pins (12; FIG. 2), which may prevent pin breakage, aberrant electrical contact between the pins, and/or connector or device malfunction.

Figure 14:
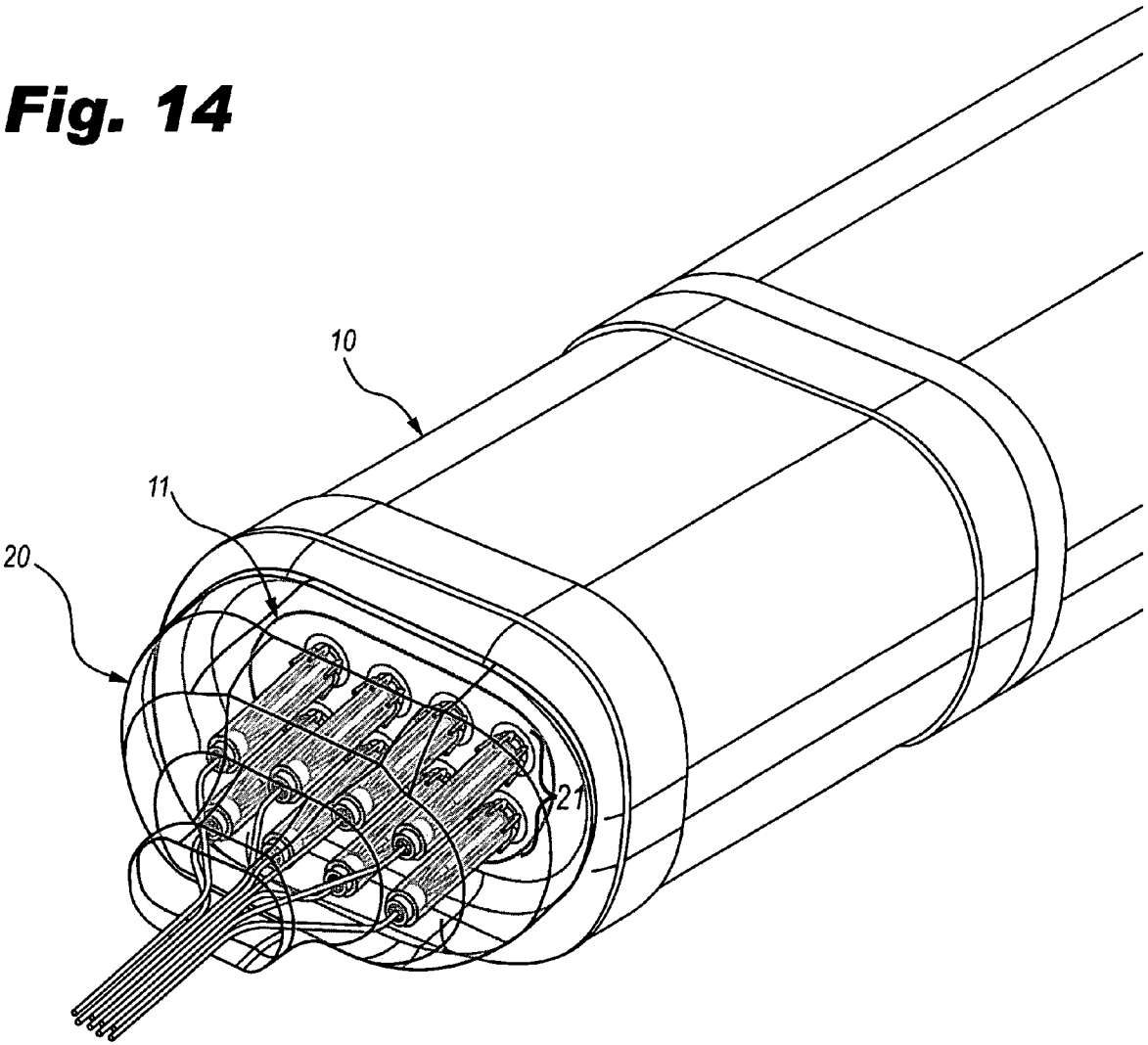
FIG. 14 is a perspective view showing the exemplary receptacle connector assembly mated with the exemplary pin array connector assembly according to principles described herein.

FIG. 14 is a perspective view showing the exemplary receptacle connector assembly (20) mated with the exemplary pin array connector assembly (11). As shown in FIG. 14, the exemplary pin array connector assembly (11) is coupled to an implantable device (10). In some examples, the pressure of the socket assemblies (21) applied to the pins (12) inserted therein causes the receptacle connector assembly (20) to remain mated with the pin array connector assembly (11). In some alternative examples, one or more additional locking mechanisms (e.g., sutures, clips, hooks, etc.) may be used to hold the receptacle connector assembly (20) in place.

The preceding description has been presented only to illustrate and describe embodiments of the invention. It is not intended to be exhaustive or to limit the invention to any precise form disclosed. Many modifications and variations are possible in light of the above teaching.

What is claimed is:

1. A receptacle connector assembly configured to mate with a pin array connector assembly having a number of pins, said receptacle connector assembly comprising:

a number of socket assemblies configured to mate with said pins;

wherein each of said socket assemblies comprises an elastomeric sleeve surrounding a number of conductive wires that are arranged to form a cavity dimensioned and arranged to receive and make electrical contact with one of said pins;

wherein a distal portion of at least one of said conductive wires exits said elastomeric sleeve; and wherein an end of said at least one of said conductive wires remains within said elastomeric sleeve and returns back against an outer surface of said elastomeric sleeve.

2. The receptacle connector assembly of claim 1, wherein said elastomeric sleeve comprises at least one or more of silicone rubber, polyurethane rubber, polychloroprene rubber, polyisoprene, and polybutadiene.

3. The receptacle connector assembly of claim 1, wherein said number of conductive wires comprises six conductive wires.

4. The receptacle connector assembly of claim 1, further comprising:

a number of at least partially insulated conductive wires configured to electrically couple each of said socket assemblies to electronic circuitry within a device connected to said receptacle connector assembly.

5. The receptacle connector assembly of claim 1, wherein said receptacle connector assembly is configured to adapt to at least one or both of a misalignment of said pins in said pin array connector assembly and a variation in dimension of said pins in said pin array connector assembly.

6. The receptacle connector assembly of claim 1, further comprising a locking mechanism configured to secure a connection between said receptacle connector assembly and said pin array connector assembly.

7. The receptacle connector assembly of claim 1, further comprising:

an insulative housing configured to house said socket assemblies;

wherein said socket assemblies are molded into said insulative housing.

8. The receptacle connector assembly of claim 7, wherein said insulative housing comprises at least one or more of silicone rubber, polyurethane rubber, polychloroprene rubber, polyisoprene, and polybutadiene.

9. A system for electrically coupling a first device to a second device, said system comprising:

a pin array connector assembly having a number of pins, said pin array connector assembly being a part of said first device; and a receptacle connector assembly that is a part of said second device, said receptacle connector assembly comprising a number of socket assemblies configured to mate with said pins;

wherein each of said socket assemblies comprises an elastomeric sleeve surrounding a number of conductive wires that are arranged to form a cavity dimensioned and arranged to receive and make electrical contact with one of said pins;

wherein a distal portion of at least one of said conductive wires exits said elastomeric sleeve and returns back against an outer surface of said elastomeric sleeve; and wherein an end of said at least one of said conductive wires remains within said elastomeric sleeve.

10. The system of claim 9, wherein said receptacle connector assembly further comprises an insulative housing configured to house said socket assemblies, wherein said insulative housing comprises at least one or more of silicone rubber, polyurethane rubber, polychloroprene rubber, polyisoprene, and polybutadiene.

11. The system of claim 9, wherein said receptacle connector assembly comprises a number of at least partially insulated conductive wires configured to electrically couple each of said socket assemblies to electronic circuitry within said second device.

12. A device comprising:

a collection of socket assemblies that each define an elongate open cavity dimensioned and arranged to longitudinally receive a pin of a complementary pin array assembly, wherein each socket assembly comprises an electrical conductor that extends away from the elongate open cavity, a collection of exposed, flexible conductors disposed circumferentially around the elongate open cavity, an electrical connection between each of the flexible conductors in the collection and the electrical conductor, and an elongate elastomeric sleeve having an inner surface secured around the exposed flexible conductors, wherein the elongate elastomeric sleeve is open at a first end to allow receipt of the pin in the elongate open cavity, a first portion of at least one of said exposed, flexible conductors exits said flexible elastomeric sleeve and extends laterally away from the open first end of the elongate open cavity and a second portion of said at least one of said flexible conductors remains within said flexible elastomeric sleeve.

13. The device of claim 12 further comprising an elastomeric housing that joins the collection of socket assemblies.

* * * * *